United States Patent [19]

Wolf

[11] Patent Number: 4,534,259

[45] Date of Patent: Aug. 13, 1985

[54] CHIN REST FOR A VIOLIN OR THE LIKE

[76] Inventor: Wilhelm Wolf, DeMeern, Netherlands

[21] Appl. No.: 461,756

[22] Filed: Jan. 28, 1983

[30] Foreign Application Priority Data

Feb. 15, 1982 [DE] Fed. Rep. of Germany ..... 3205292
Sep. 4, 1982 [DE] Fed. Rep. of Germany ..... 3232996

[51] Int. Cl.[3] ..... G10D 3/18

[52] U.S. Cl. ..... 84/279; 84/311; 84/329

[58] Field of Search ..... 84/278–280, 84/310–312, 329

[56] References Cited

U.S. PATENT DOCUMENTS

| | | | |
|---|---|---|---|
| 368,893 | 8/1887 | Lowenthal | 84/279 |
| 2,486,646 | 11/1949 | Halko | 84/279 |
| 3,124,991 | 3/1964 | Costen | 84/313 X |
| 4,248,125 | 2/1981 | Everett | 84/280 |

FOREIGN PATENT DOCUMENTS

| | | | |
|---|---|---|---|
| 2944281 | 5/1981 | Fed. Rep. of Germany . | |
| 18695 | of 1903 | United Kingdom | 84/279 |
| 5179 | of 1915 | United Kingdom | 84/279 |
| 108283 | 8/1917 | United Kingdom | 84/279 |

*Primary Examiner*—Lawrence R. Franklin
*Attorney, Agent, or Firm*—Merchant, Gould, Smith, Edell, Welter & Schmidt

[57] ABSTRACT

The invention proposes a chin rest for a string instrument, e.g. a violin or fiddle, that is equipped, in its chin rest plate, with an opening that enables a better conformance of the chin rest to the human contour and that is possibly held in pivotable fashion to the body of the string instrument and, therewith, can follow the pivoting motions of the head of the person using the instrument. Furthermore, the chin rest is combined with a so-called damper support.

3 Claims, 4 Drawing Figures

CHIN REST FOR A VIOLIN OR THE LIKE

TECHNICAL FIELD

The invention relates to a chin rest for a violin or the like, with one or several support brackets gripping about the body of the violin and capable of being clamped to said body, as well as to a chin rest plate made of a material capable of furnishing support and borne by the support brackets.

BACKGROUND OF THE INVENTION

Known from DE-OS No. 29 44 281 is a chin rest which, like all previously known chin rests, is clamped in stationary fashion to the body of the string instrument. Here, clamping is accomplished either by means of a support bracket gripping onto the violin base and the violin sounding board, or by making use of the so-called tailpiece head.

The disadvantage is the same for all known arrangements in that the actual chin rest plate is attached in stationary fashion on the violin and is, of course, to be adapted in its curvature to the chin, but cannot be individually fitted to the chin. If there were superimposed a covering that would be flexible enough to enable an individual fitting of the chin rest plate to the chin of the user of the instrument, secure support of the instrument would no longer be guaranteed.

Resulting from the previously known construction of the chin rest is not only a certain unwieldiness of the instrument, but rather also stresses on the chin that can easily lead to inflammations of the chin, particularly in the case of professional musicians who have to hold the instrument in the position of use for a long time. The task set forth for the invention is to obtain a chin rest that is capable of adapting itself to individual chin structures and/or that is constructed for adapting to the individual chin structure, and with which a positive support of the instrument is nevertheless guaranteed.

This task set forth for the invention is resolved by an opening provided in the center region of the fixed chin rest plate which, at its circumferential edges, is fitted to the circumferential edges of the chin rest plate and, therewith, adjusted to the individual shapes of a human chin.

Achieved by such an arrangement is that there is guaranteed a positive support of the instrument at the chin, and that individual structures of the jaw bone are taken into account by the free passthrough opening of the chin rest plate.

In doing this, it is possible, in accordance with the invention, to proceed such that the previously usual type chin rest plate consisting of material capable of furnishing support be provided with the opening, or that a chin rest base plate be equipped with an opening, whereby the chin rest base plate is then equipped with an elastically flexible covering ply.

A further task set forth by the invention is to obtain a chin rest capable of following the pivoting movements of the head with a same position of the instrument.

The actual angle of pivot of the chin rest need not be especially great, and it appears to be advantageous to limit the pivoting movements to either side by means of stops.

In accordance with one essential feature of the invention, further provided is that there occur an automatic return of the chin rest to the initial position by means of built-in spring element, with either two, or even only one, appropriately arranged return springs being provided.

To further reduce annoyance to the body by the chin rest, proposed in accordance with the invention is that the top side of the chin rest indeed be adapted to the shape of the chin, but that it display a flexible covering ply or be equipped with an inflatable cushion that best adapts itself to the individual body shape in the position of use.

Also found disadvantageous in using previous instruments was that the damper (mute, attenuator) that needed always to be used is not mounted in a location favorable for clamping and free from shifting relative to its support.

The invention further resolves this problem in that there is associated with the chin rest a likewise, preferentially pivotably structured damper support that is capable of holding the damper in a position favorable for striking, whereby, if such a damper is not to be maintained ready for striking, the damper support can be pivoted into an at-rest position in which it is possibly no longer visible from the outside.

BRIEF DESCRIPTION OF THE DRAWINGS

Advantageous embodiments of the invention will be explained in the following with the aid of the drawings. Here, the drawings show in FIG. 1 a usual type of chin rest made of wood with an opening worked into it, in FIG. 2 a fixed chin rest base plate with elastically flexible covering ply and in FIG. 3 a pivotable structuring of the chin rest plate.

DETAILED DESCRIPTION OF THE INVENTION

Figure 3:
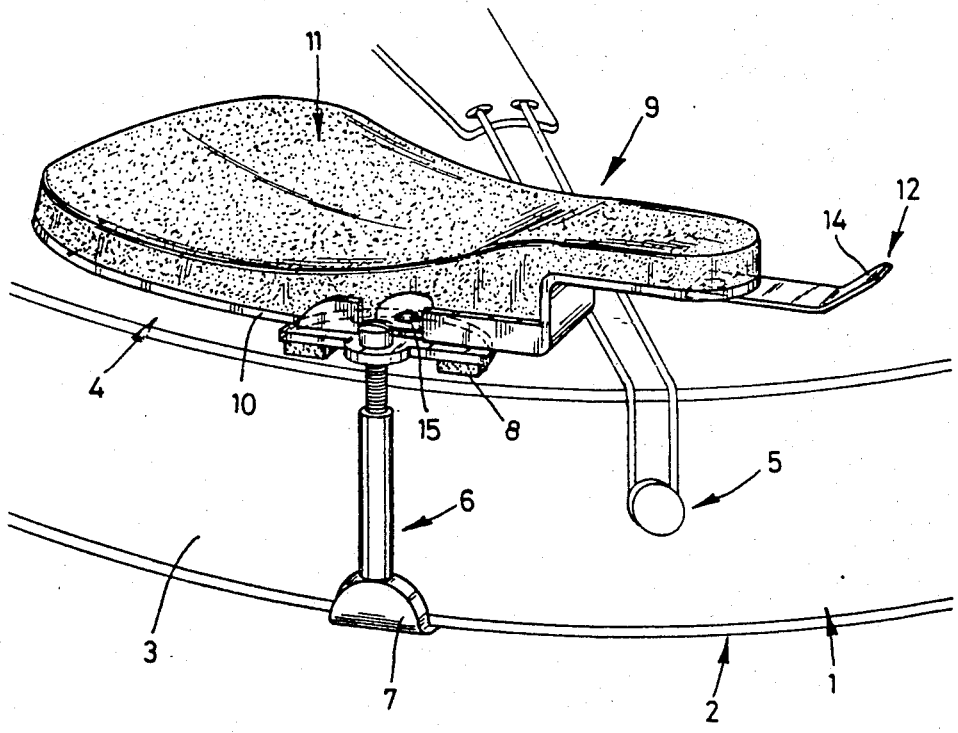
Figure 4:
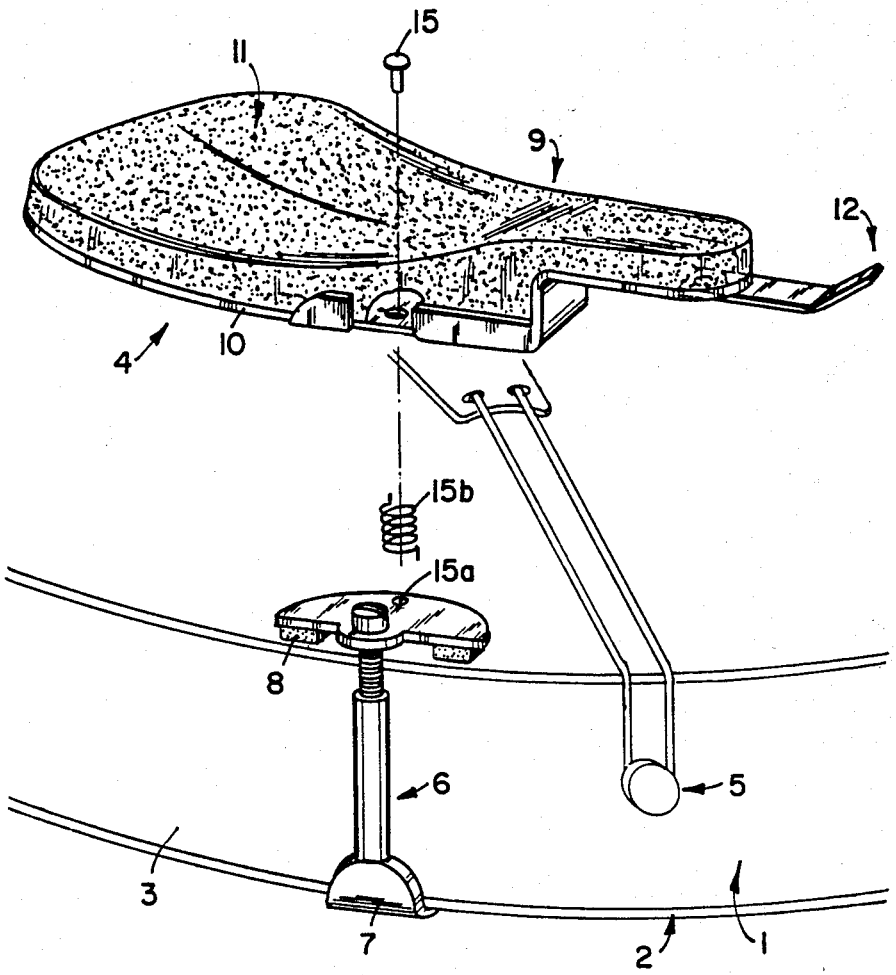
FIG. 4 is a view like FIG. 3 except the parts are exploded.

In FIG. 3, designated with 1 is the body of a string instrument, with this body 1 being formed in a manner known per se by a bottom 2, a rib 3 and a sounding board 4. Illustrated at 5 is a so-called tailpiece button (stud). The components are generally known.

In the example of embodiment shown, the body 1 is gripped about by a support bracket 6 displaying a support bracket foot 7 gripping onto bottom 2 and a support bracket head 8 gripping onto the sounding board 4 of the body 1. Both components 7 and 8 are joined together by means of a connector, in a manner known per se, such that a firm clamping of the support bracket foot 7 and of the support bracket head 8 to the bottom 2 is possible.

The actual chin rest is designated with 9 and, in the case of example of embodiment illustrated, consists of a chin rest base plate 10 that is covered over on its top side, for example with a covering ply 11 made of an elastically flexible material, with this top side being embodied in a manner known per se, in adaptation to the shape of the body.

In the example of embodiment illustrated, the chin rest base plate 10 grips the stationary support bracket head 8 such that pivoting of the actual chin rest 9 about a vertical axis (at pivot 15) is possible, i.e. an axis that runs parallel to the support bracket 6. Here, the pivoting movement needs to amount only to about 20°, i.e. is relatively small and sufficient to enable the desired head rotation of the user of the instrument.

In order to continually return the chin rest 9 to the initial position, it is possible to provide a return spring 15*b* and a pivot point such as rivot 15 which is inserted through the spring into hole 15*a*.

It is evidently also possible that a one-piece chin rest, known per se, be installed in place of the chin rest base plate 10 and the separate covering ply 11, the invention not being limited to the method of pivot bearing capability illustrated.

As already stated, also lying within the scope of the invention is to replace the covering ply 11 by an elastically deformable cushion.

Arranged at 12 is a so-called damper holder that grips pivotably to the underside of the chin rest base plate 10 and that bears a bent armpiece 14 intended for acceptance of the actual damper, which is not illustrated.

The damper holder 12 can be pivoted back into a non-use position, while in the drawing it is illustrated in the position of use.

Naturally, it is possible, instead of the method of attachment of the damper holder 12 to the chin rest base plate 10 illustrated, to select a different form of embodiment, whereby the actual chin rest 9 is essentially combined with the damper holder 12.

Figure 1:
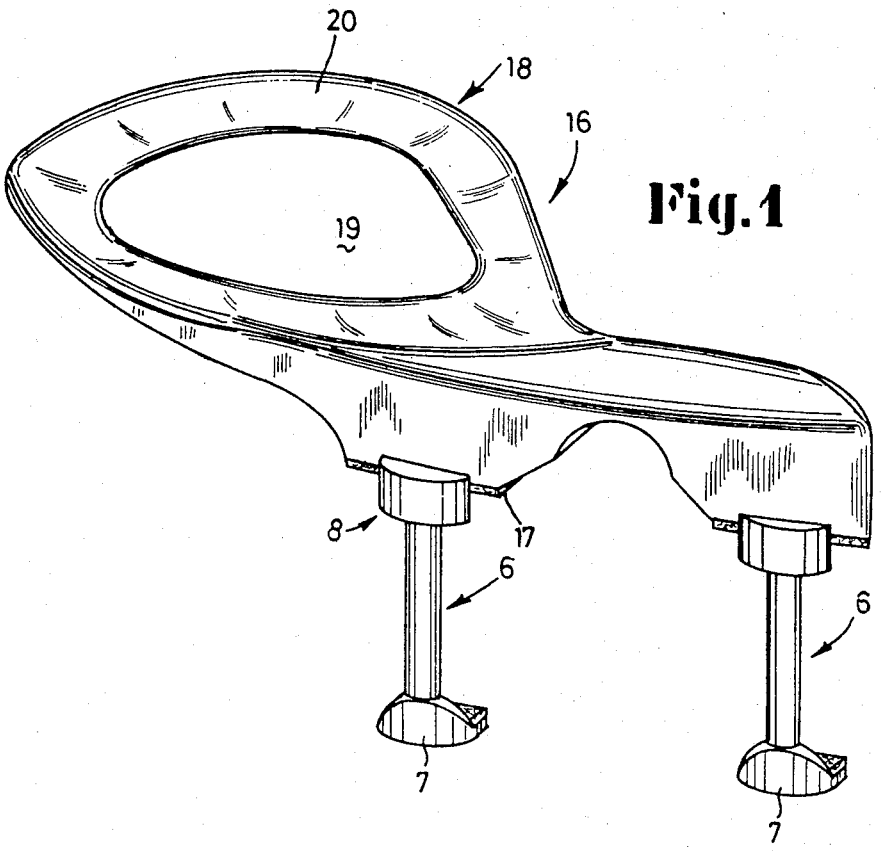
Figure 2:
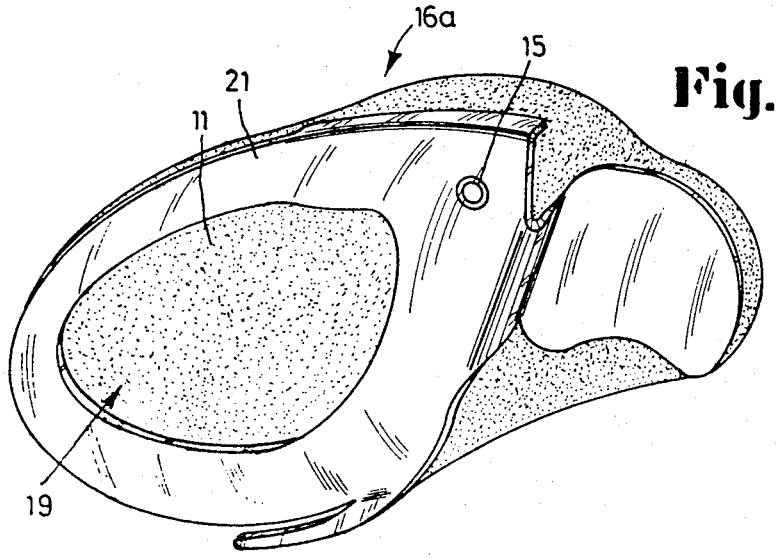

Designated with 16 in FIG. 1 and 2 is a chin rest made, for example, of wood, that can be joined with the body of the violin via support brackets 6 that are firmly joined with the chin rest 16. For this purpose, support brackets 6 display support bracket feet 7 and support bracket heads 8, with a flexible layer of cork 17 capable of being inserted between the underside of the chin rest 16 and the body of the violin, which is not illustrated.

The actual chin rest 16 displays, in its chin rest plate 18, an opening 19 that is adapted in its outer form to the outer form of the chin rest plate 18 and, therewith, is adapted to approximately the given form of a human chin. The transition from the opening 19 to the edge of regions 20 of the chin rest plate 18 runs in smoothly ascending fashion so that, here, there occurs no pressure stressing of human skin or bone.

Illustrated in FIG. 2 is a chin rest 16*a* that consists of a fixed chin rest base plate 21 made of a material capable of providing support, in which there is likewise cut an opening 19. Here, the chin rest base plate 21 is equipped with an elastically flexible covering ply 11 that covers over the chin rest base plate and running towards the top. Illustrated at 15 is a pivot for acceptance of a pivoting axle with which the actual chin rest 16 is firmly attached to the device.

Obtained by the invention is a chin rest which, in ways not achieved before, is capable of being adapted to the shapes of the human chin and that, nevertheless, guarantees a positive holding of the instrument.

I claim:

1. A chin rest for a violin or the like comprising:

a chin rest attached to a chin rest base plate;

at least one support beacket adapted to grip the body of said violin;

pivot means pivotally connecting said base plate to said support bracket; and a return spring biassing said base plate to a start position.

2. A chin rest according to claim 1 wherein stop means are provided on said base plate and said support bracket for limiting the pivotal movement of said base plate.

3. A chin rest according to claim 2 wherein the angle through which said chin rest base plate is capable of pivoting is twenty degrees.

* * * * *

UNITED STATES PATENT AND TRADEMARK OFFICE

CERTIFICATE OF CORRECTION

PATENT NO. : 4,534,259

DATED : 13 August 1985

INVENTOR(S) : Wilhelm Wolf

It is certified that error appears in the above-identified patent and that said Letters Patent is hereby corrected as shown below:

Column 4, line 22, "beacket" should be --bracket--;

Signed and Sealed this

*Twenty-first* Day of *January 1986*

[SEAL]

*Attest:*

DONALD J. QUIGG

*Attesting Officer*

*Commissioner of Patents and Trademarks*